US005351616A

United States Patent [19]

Gelinas et al.

[11] Patent Number: 5,351,616

[45] Date of Patent: Oct. 4, 1994

[54] ROTARY WEB PRINTING MACHINE, PARTICULARLY FOR PRINTING ON THICK OR CARTON-TYPE STOCK WEBS WITH REPLACEABLE PLATE CYLINDERS

[75] Inventors: W. Robert Gelinas, Jewett City, Conn.; Roland D. Horth, Burlington, Mass.

[73] Assignee: MAN Roland Druckmaschinen AG, Offenbach am Main, Fed. Rep. of Germany

[21] Appl. No.: 95,361

[22] Filed: Jul. 21, 1993

Related U.S. Application Data

[63] Continuation of Ser. No. 929,999, Aug. 13, 1992, abandoned.

[51] Int. Cl.[5] ..... B41F 5/22; B41F 27/00; B41L 35/32

[52] U.S. Cl. ..... 101/218; 101/247

[58] Field of Search ..... 101/216, 217, 247, 351, 101/352, 217, 218, 177, 174, 178, 137, 139–140, 142–145, 182, 184

[56] References Cited

U.S. PATENT DOCUMENTS

| | | | |
|---|---|---|---|
| 2,258,653 | 10/1941 | Klingelfuss | 101/351 X |
| 2,690,127 | 9/1954 | Auerbacher et al. | 101/247 X |
| 2,982,204 | 5/1961 | Roehm | 101/247 |
| 3,598,050 | 8/1971 | Thompson . | |

FOREIGN PATENT DOCUMENTS

| | | |
|---|---|---|
| 352364A3 | 1/1990 | European Pat. Off. . |
| 1611270 | 3/1972 | Fed. Rep. of Germany . |
| 2229140 | 9/1990 | United Kingdom . |

*Primary Examiner*—J. Reed Fisher

*Attorney, Agent, or Firm*—Frishauf, Holtz, Goodman & Woodward

[57] ABSTRACT

To permit ready exchange of the length of printed subject matter to be reproduced, particularly to make packaging cartons, the cut-off size of printing cylinders, as well as blanket cylinders of an offset machine is constructed, can be changed in this manner: The respective cylinders include a cylinder shaft (44, 45) on which a lightweight cylinder sleeve (3, 3*a*, 4, 4*a*) of different circumferential size can be placed. The shafts, which can be of steel, are retained on movable support arms to swing about drive gears (23, 28) fixed in the machine, the support arms on one side wall (1) of the machine being axially movable out of the way through a window (51) formed in one side wall (1) to permit replacing the sleeves (3, 3*a*, 4, 4*a*) and, upon re-seating and re-positioning by pneumatically loaded spindles, maintaining engagement with the fixed drive gears (23, 28), as well as with inker and/or damper application rollers (8, 9, 10), some of which can be movable and some of which are fixed in the frame of the machine, also preferably pneumatically loaded. An impression cylinder (5), pneumatically and mechanically supported, is movable against the blanket cylinder sleeve (4, 4*a*), and positioned in the machine in accordance with the respective size of the sleeves (3, 3*a*, 4, 4*a*) on the printing cylinder shaft (44) and the blanket cylinder shaft (45), respectively. The sleeves are seated on the shafts by a conical end seat, from which they can be pushed out by hydraulic pressure.

20 Claims, 13 Drawing Sheets

ROTARY WEB PRINTING MACHINE, PARTICULARLY FOR PRINTING ON THICK OR CARTON-TYPE STOCK WEBS WITH REPLACEABLE PLATE CYLINDERS

This application is a continuation of application Ser. No. 07/929,999, filed Aug. 13, 1992 now abandoned.

FIELD OF THE INVENTION

The present invention relates to printing machines, and more particularly to rotary web printing machines, in which plate cylinders of different sizes can be installed in the machine to permit printing images of different formats on heavy or carton-type stock webs, suitable for making packages for merchandise.

BACKGROUND

Rotary printing machines, particularly printing machines adapted to print on heavy or carton-type stock webs, as generally used, require exchange of the entire cylinders if the sizes of the cylinders have to be changed. These cylinders are heavy and complete exchange of the cylinders is complex and time-consuming. Endless printing, that is, printing on cylinders which do not have an axial plate clamping groove, also was not previously possible.

THE INVENTION

It is an object to improve printing machines, and more particularly printing machines capable of endless printing on heavy or carton-type stock material, in which it is no longer necessary to completely exchange the entire printing cylinder, or printing cylinder couples having a plate cylinder and an offset or blanket cylinder.

Briefly, a printing cylinder shaft or core has a printing cylinder sleeve secured thereover, which is held on the shaft at end portions, so as to be removable from the shaft or core, for example by rotation-symmetrical support elements placed at the axial ends of the printing cylinder sleeve. The removed sleeve can be replaced by a sleeve of different circumferential or diametrical dimension. The sleeves form a set of sleeves of different circumferential or cut-off sizes. The printing cylinder shaft or core has a drive gear coupled thereto. The shaft or core is retained within the printing cylinder frame on movable support arms, preferably pivotable about the axis of rotation of a printing unit drive gear, so that the cylinder drive gear can be in meshing engagement with the printing unit drive gear while being shifted along its circumference to accomodate sleeves of different sizes on the printing cylinder shaft or core. Preferably, one of the side walls is formed with an access opening, to permit disengagement of one side of the holding system for the printing cylinder and exchange of the sleeve while leaving the shaft in the machine. The sleeve can be retained on the core by a friction fit, for example by engagement of matching conical or taper seats between the cylinder shaft or core and an end element of the printing cylinder sleeve. The printing machine, of course, also has an inker and, if lithographic printing is intended, a dampener. The inker and dampener have application rollers operable about shiftable centers of rotation, for surface engagement with printing sleeves of different sizes.

In accordance with a feature of the invention, the printing machine is an offset rotary web printing machine and support arms are provided not only for a printing plate cylinder but also for an offset cylinder which, likewise, can have its axis of rotation shifted about a meshing gear. An impression cylinder, for example positioned below the plate cylinder-blanket cylinder couple, is movable for engagement against the blanket cylinder.

The system has the substantial advantage that the sleeves can be exchanged independently of the entire printing cylinder. The shafts or cores of the respective cylinders, which may be form cylinders, plate cylinders or blanket cylinders, are typically made of steel. The sleeve surrounding the core, however, and forming the complete cylinder, can be made of a light-weight metal, for example aluminum, or other light-weight materials, and thus the overall weight to be handled when exchanging sleeves can be reduced to the point where the sleeves can be carried readily by one person. For printing of cardboard boxes, typical cylinders will have axial lengths of between about ½ to 1 meter. If the cylinder sleeve is made of aluminum, a wall thickness of about 2½ cm is suitable. A cylinder of about 35 cm cut-off dimension, that is, having a circumference of about 35 cm, made of 1" (about 2.5 cm) thick aluminum and about 60 cm long, would weigh only about 10–11 kg, a weight that can easily be carried by one operator. A cylinder having double the diameter (and hence twice the circumference) would weigh twice as much.

The steel shaft or core, typically, has a diameter of about 5 cm, and weighs about 18 kg.

The end elements of the cylinder sleeves, one of which, typically, is formed with a conical seating surface to seat on a matching conical portion of the shaft, may include steel inserts. For a good friction fit, the cylinder sleeves can be fitted on the conical ends by hydraulic pressure; for removal, likewise, hydraulic pressure can be applied to separate the conical seats.

The machine, thus, has the advantage that it is not necessary to exchange entire plate cylinder-blanket cylinder combinations together; these combinations, even if contained in replaceable cartridge units, are heavy and costly. The present invention permits replacing only the much lighter weight sleeves surrounding the cylinder shafts, which is simple to carry out and permits storing of a substantial number of cylinder sleeves of different sizes forming a set of sleeves fitting on the cylinder shaft, to print in one revolution subject matter of different longitudinal extent.

The circumferentially continuous sleeves permit elimination of clamping grooves or clamping gaps for printing plates or blankets. Rather, the printing blankets or the plates can be secured directly on the cylinders, and form part thereof. Gapless printing, that is, printing with circumferentially continuous surfaces, permits higher printing speeds. The apparatus, with the re-positioning structure which, in accordance with a feature of the invention, can be power-operated, permits exchange of printing sleeves of different sizes within about 5 minutes without heavy lifting of large structures.

The printing machine can provide high-quality printing, in which the tone, color saturation and hue of all printed material is identical. This is particularly important when printing display cartons, for example for food boxes, which at point-of-sale are stacked next to each other. If there is any variation in color toning, saturation or hue, customers are apt to reject differently colored cartons since the impression may have been obtained that they have faded and that the contents may be stale. The requirements of printing quality on packaging cartons, which are displayed adjacent each other, thus is substantially higher than those placed on advertising flyers or advertising material where comparison between adjacently located identical printed subject matter does not occur.

DRAWINGS

Figure 9:
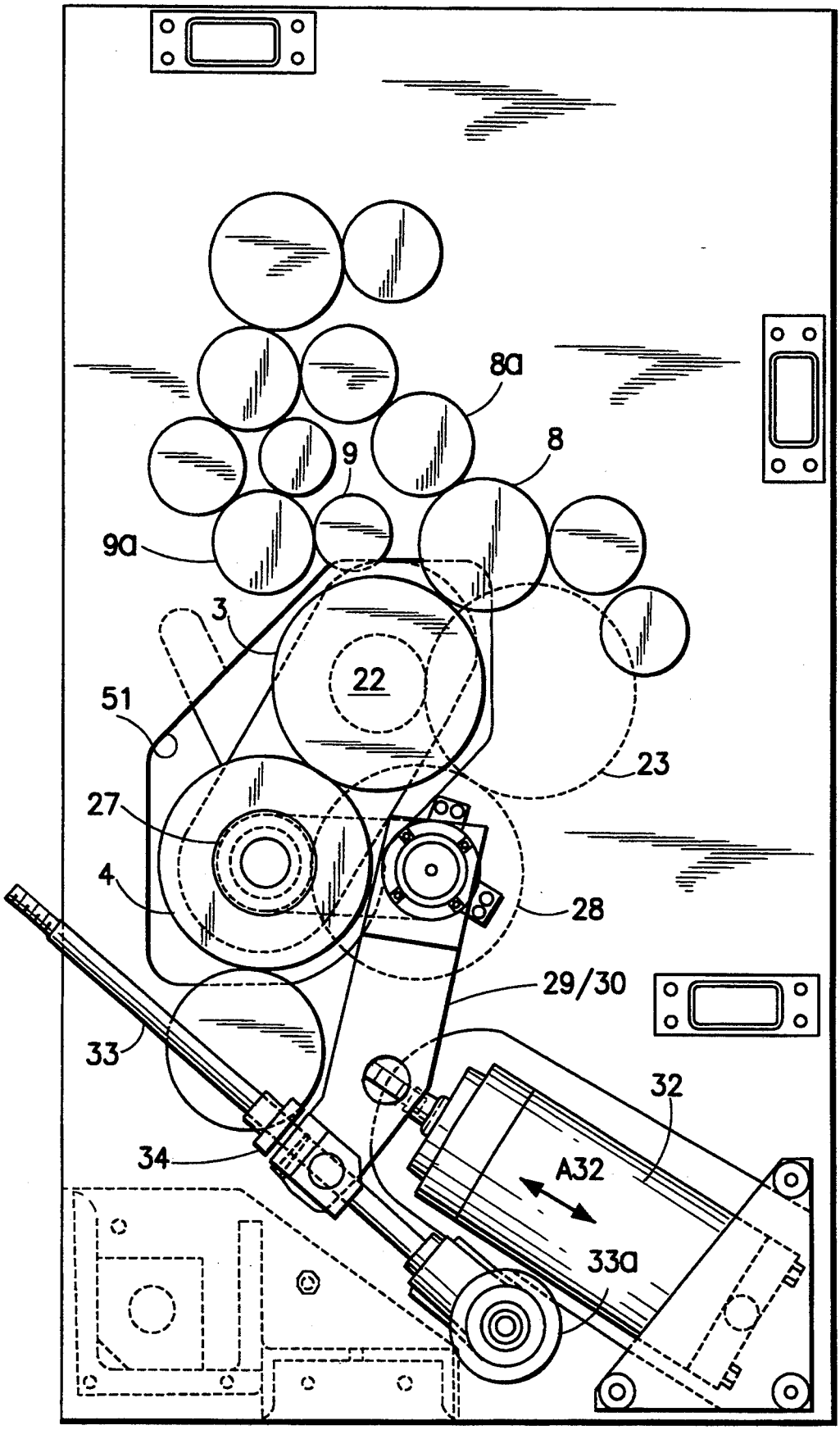
Figure 10:
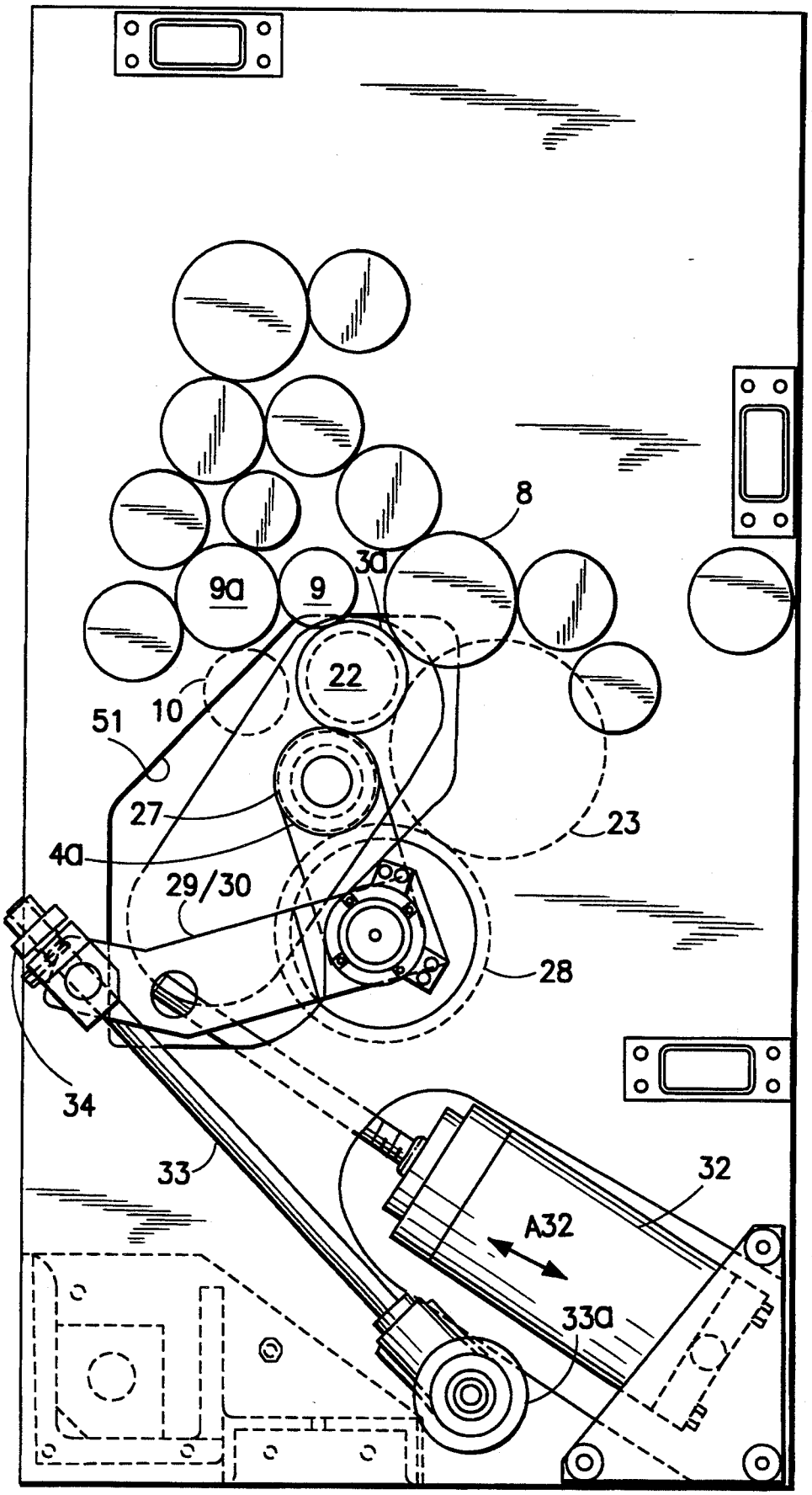
Figure 11:
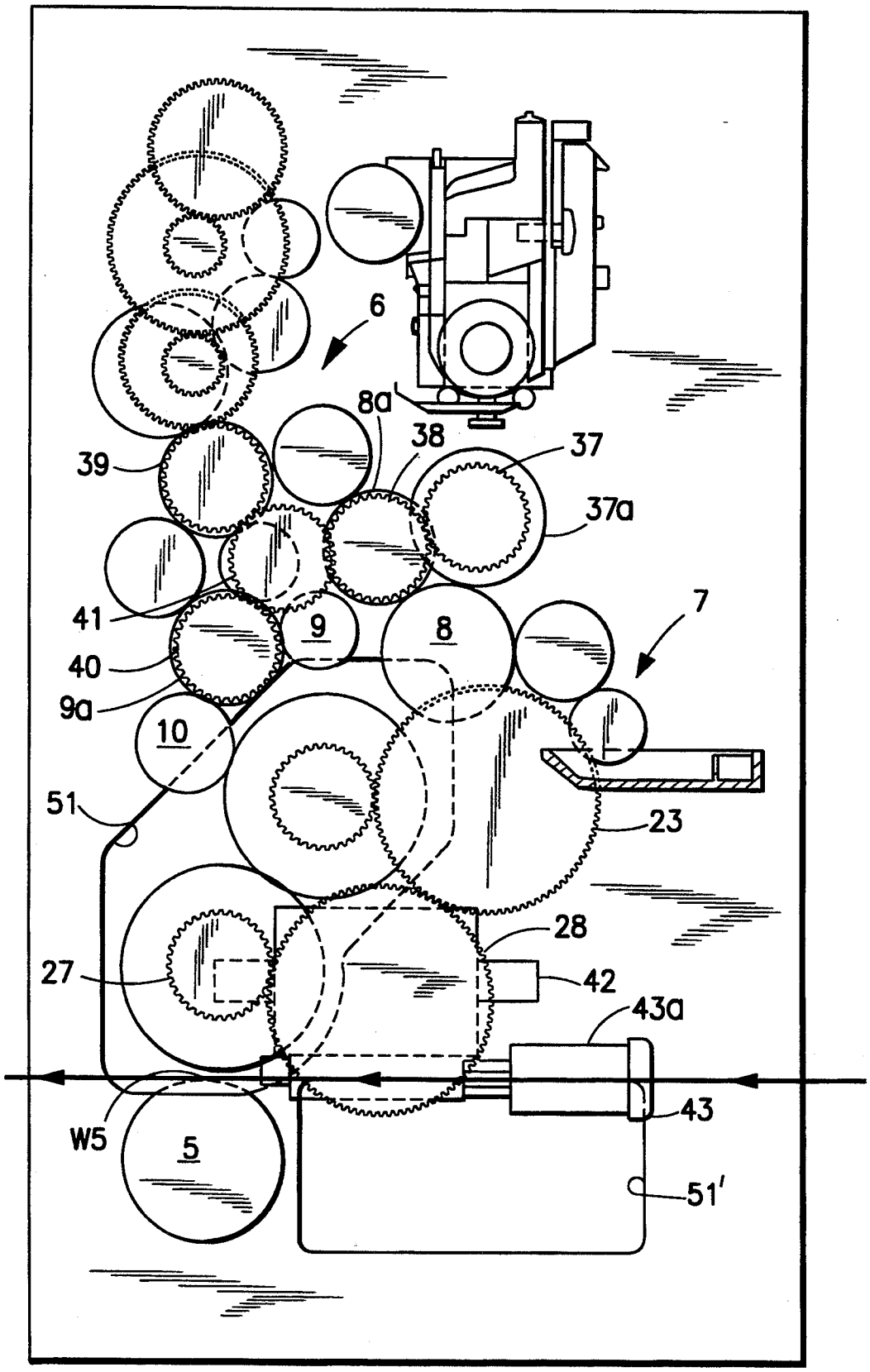
Figure 12:
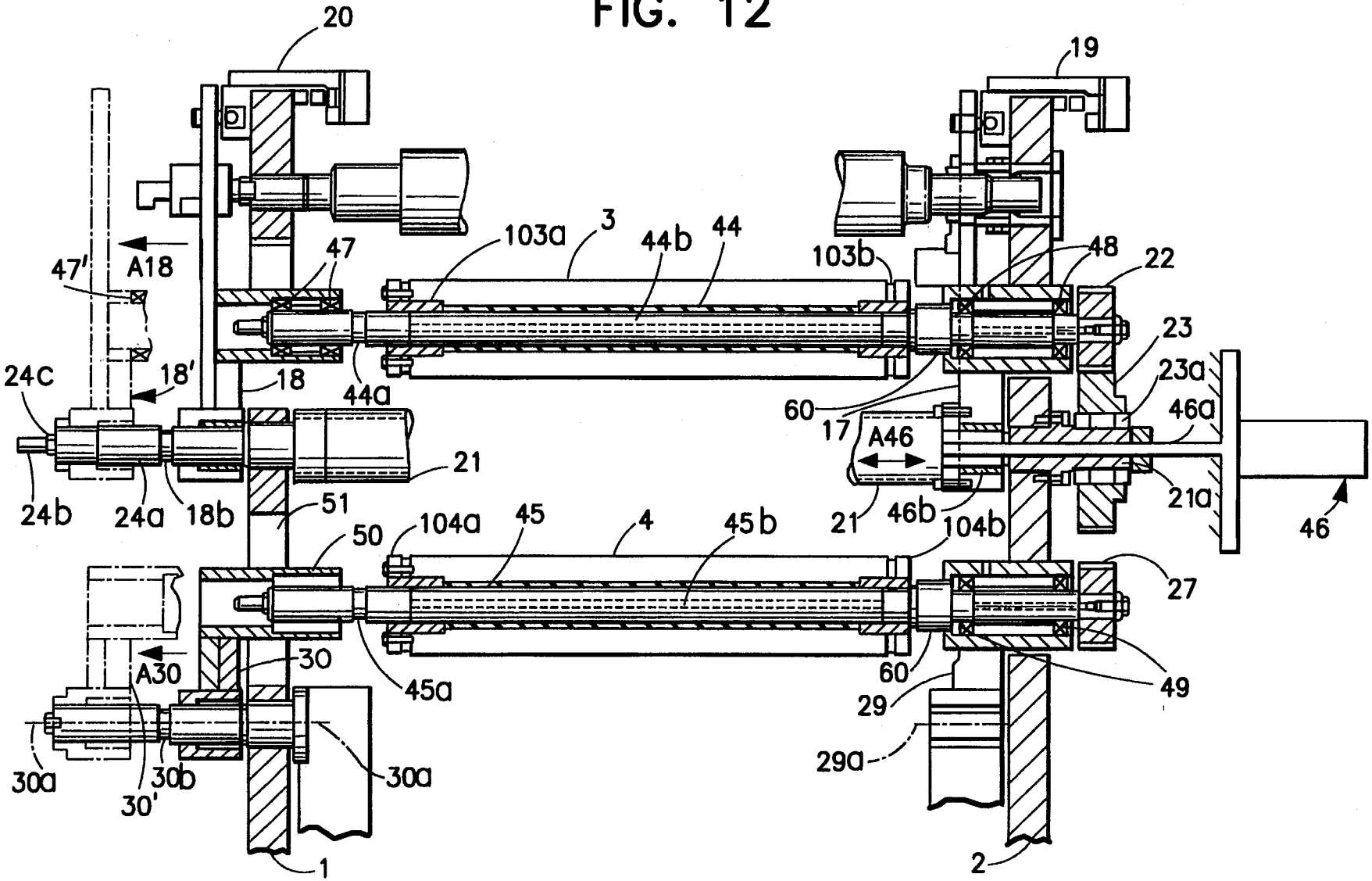
Figure 13:
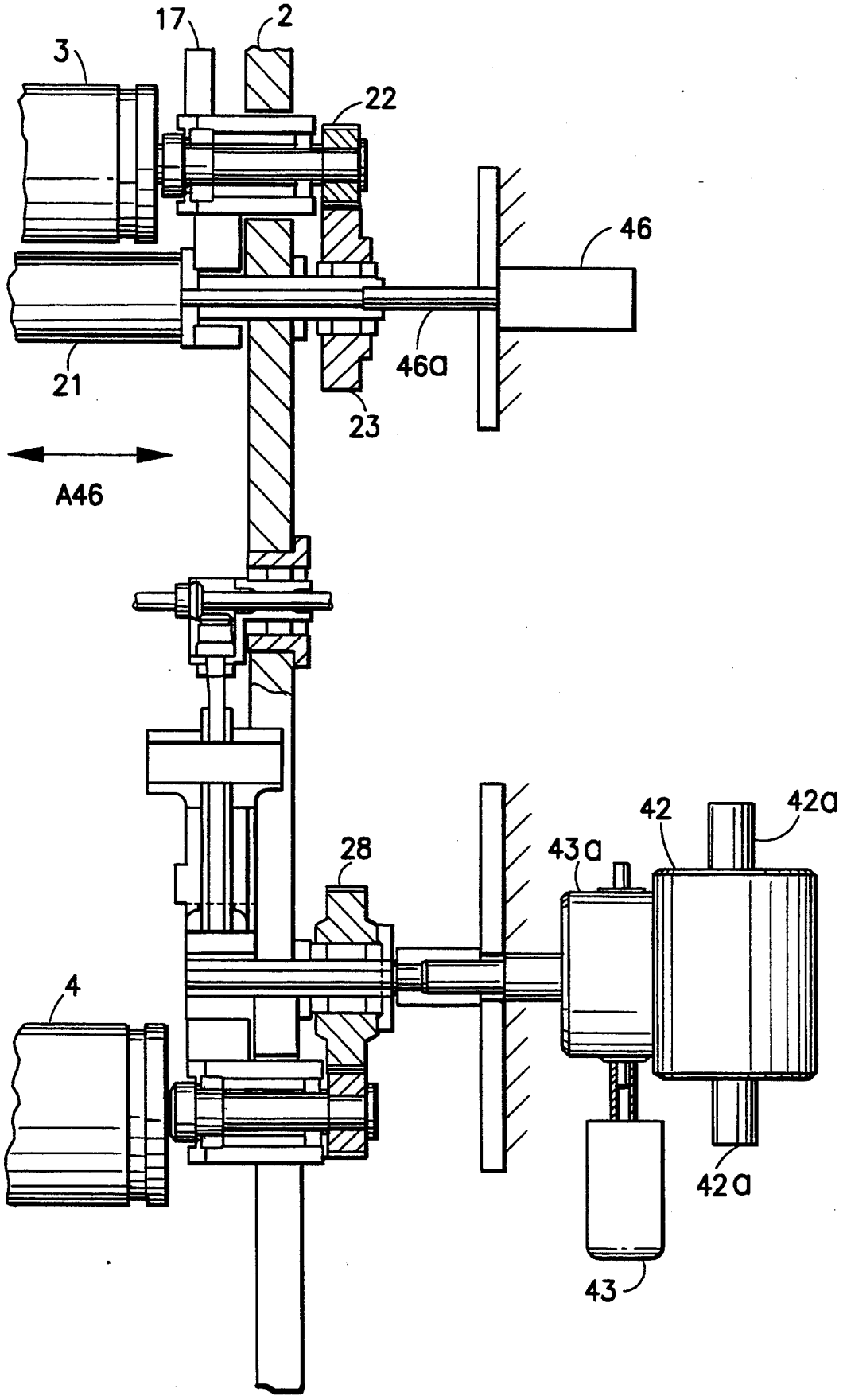

FIGS. 9 and 10, highly schematically, show how plate cylinders and blanket cylinders with cylinder sleeves of different dimensions are positioned in the printing machine, in which, respectively, maximum size (FIG. 9) and minimum size (FIG. 10) of the dimensions are shown, together with engagement of the respective cylinder shafts with their drive gears;

FIG. 11 is a schematic side view of the drive gearing;

FIG. 12 is a fragmentary vertical sectional view illustrating freeing one side of the shafts of the plate and blanket cylinders, respectively, for replacement of the respective cylinder sleeves; and FIG. 13 illustrates, schematically, lateral and circumferential register adjustment devices.

DETAILED DESCRIPTION

The printing machine station or unit described herein is especially suitable for printing on heavy webs or stock W, suitable for manufacture into cartons. The invention will be described in connection with a rotary web offset printing machine station 100 although, of course, it is equally applicable to direct printing. Printing machine units printing by offset, as well as by direct printing, can also be used together in a printing system, in which the printing stations print on one continuous web. The printing machine can also be used in any printing station, unit or system which uses direct or indirect printing methods, for example for flexo printing, rather than standard offset printing.

The printing unit or station 100 has right and left side walls 1, 2 (FIG. 12). In accordance with a feature of the invention, rather than having plate cylinders or form cylinders, blanket cylinders such as transfer or offset cylinders or other similar cylinders installed therein, the printing machine has cores or shafts which are retained in the machine, and on which exchangeable sleeves are mounted. The sleeves can be supplied in sets of respectively different diameters. The sizes of the sleeves are usually measured by their cut-off lenghth, that is, the maximum length that a printed image can be placed thereon. Typical cut-off lengths are, for example, about 14" (about 35 cm) for a small cylinder, which means that the cylinder will have a diameter of about 4½ (about 11 cm). Doubling the diameter, of course, doubles the cut-off length.

As best seen in FIG. 12, the plate cylinder shaft 44 has a tubular plate cylinder sleeve 3 placed thereon. The space between the shaft 44 and the tubular sleeve 3 can be empty. The sleeve 3, for example, can be an aluminum sleeve of 1" (about 25 mm) thickness on which an endless printing plate is secured, for example by an adhesive. FIG. 12 also illustrates a rubber blanket shaft 45 and a tubular blanket cylinder sleeve 4 on which an endless rubber blanket is secured, for example by vulcanization or adhesion.

The size of the sleeve 3 or 4 can be selected; in the description and drawings hereafter the sleeves will be referred to as sleeves 3, 4, collectively; to distinguish between sizes of sleeves, differently sized sleeves will be referred to as 3*a*, 4*a*, respectively. The range of variation of the cut-off sizes is determined by machine design and, for example, may vary between 14" (about 35 cm) and 30" (about 75 cm).

Figure 1:
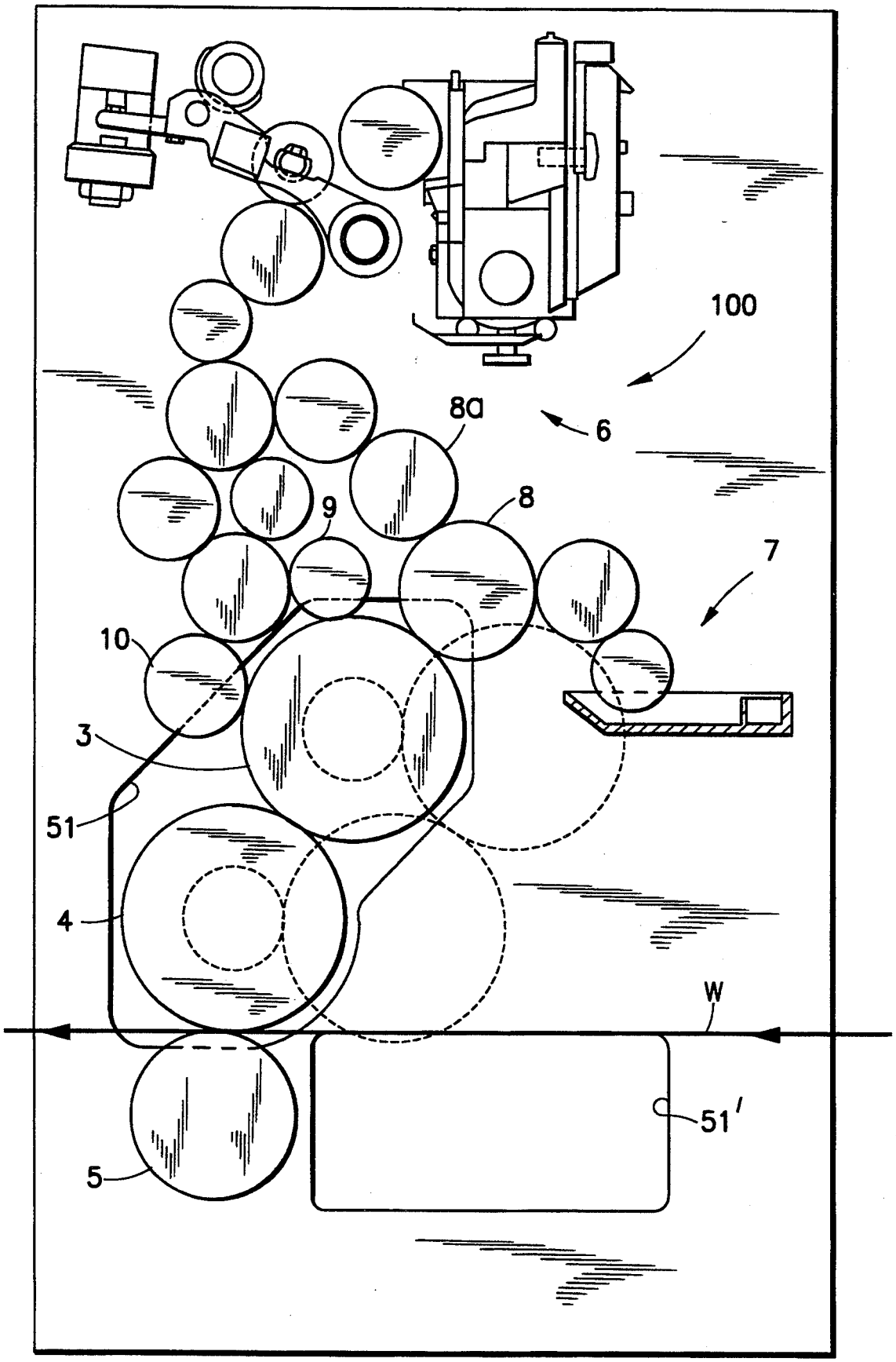
FIG. 1 is a highly schematic side view of one printing machine station or unit incorporating the present invention, and illustrating, schematically, plate cylinders and blanket cylinders of two different sizes, in which the invention is applied to an offset rotary printing machine.

The plate cylinder unit or, rather, the plate cylinder sleeves 3, 3*a* are inked by an inker 6 (FIG. 1), dampened by a dampener 7, and ink and damping fluid are applied together by a combination ink-dampener fluid application roller or cylinder 8. Ink is further applied by ink application rollers 9, 10. The image to be printed is then transferred, after inking, from the plate cylinder sleeve 3, 3*a* to the respective blanket cylinder sleeve 4, 4*a* for printing on the web W, which is engaged against the blanket cylinder by an impression cylinder 5 at a printing line W5. The web W is so thick that it can be used, later, to make packages or cartons therefrom, for example packages or cartons for retention of food products, such as cereal and the like. Heretofore, some food products were retained in blank cartons, about which, then, paper labels or paper advertisement and point-of-sale information was pasted. The present invention permits direct printing on a web of carton material with high print quality, and no degradation of print quality between adjacent printed images.

Figure 2:
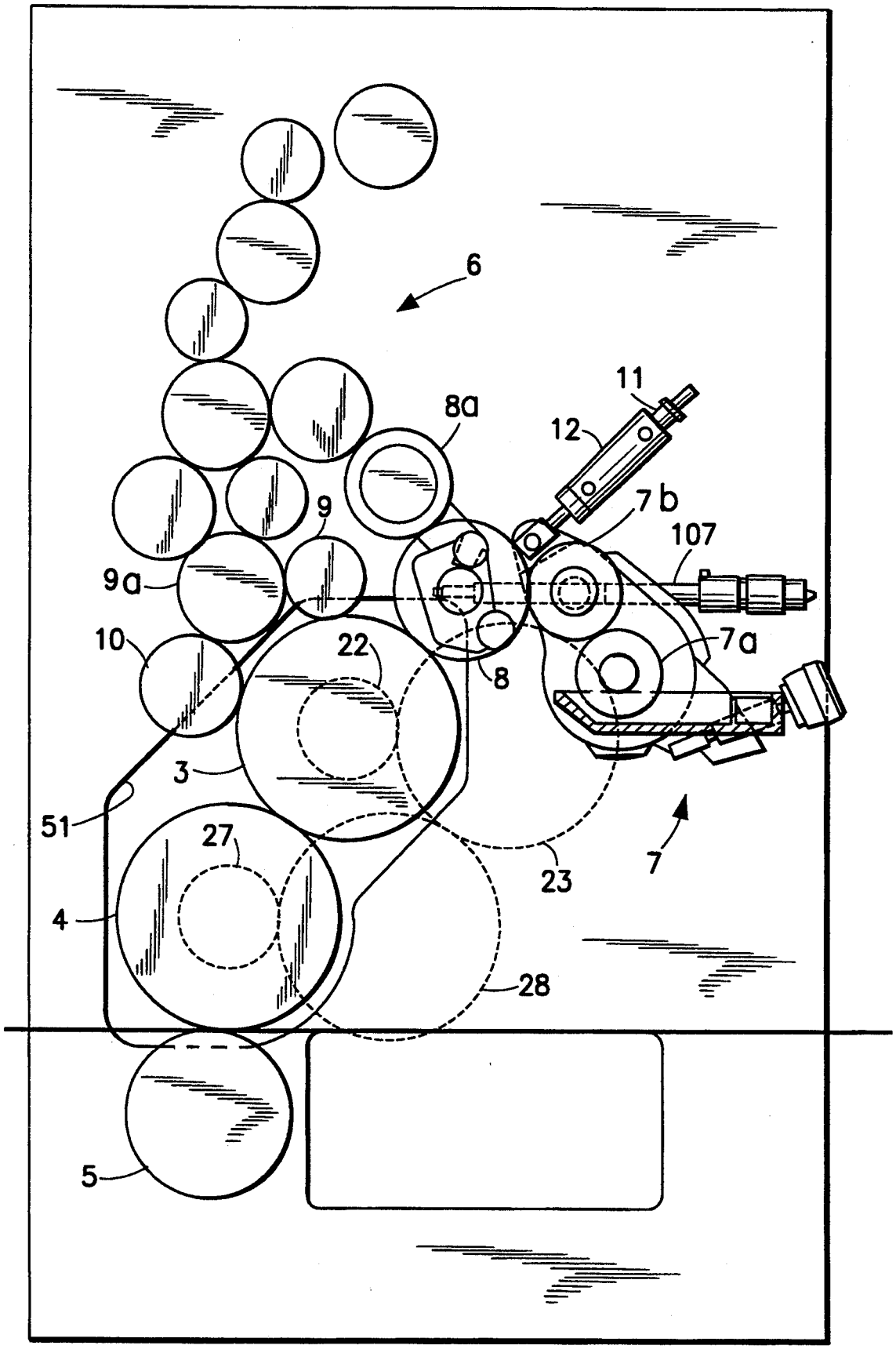
FIG. 2 is a schematic side view illustrating in detail the repositioning mechanism of a combination ink-dampening liquid application cylinder to match the position of this application roller to the size of the printing or form cylinder being used.

In accordance with a feature of the invention, different sizes of sleeve pairs, for example sleeve pairs 3, 4 or 3*a*, 4*a*, can be used in the printing machine. The cylinders 3, 4 with the sleeves are in engagement with the respective ink and ink-water application rollers 8, 9, 10 (FIG. 2). The ink application rollers 9, 10 as well as the application roller 8 can be moved within the printing machine. The application rollers 9, 10 can be pivoted about an oscillating or vibrating roller 9*a*, which has its center of rotation fixed in the side walls 1, 2 of the machine. The combination ink-dampener fluid roller 8 can be pivoted about an oscillating or vibrating roller 8a. The vibrating rollers are driven. The rollers 7a, 7b (FIG. 2) are dampener fluid application rollers forming part of the dampener 7 and, preferably, pivotable at least in part by suitable pivot arms, retained in the printing machine.

An adjustment screw 107, which can be hand-operated or motor-operated, adjusts the position of the roller 8 with respect to the damping fluid transfer roller 7b which, in turn, is in contact with the water pan roller 7a. The combination appliction roller 8 is force-loaded with air pressure against the cylinder sleeve 3, or 3a, respectively. The loading is set by providing appropriate air pressure to the air cylinder 12 and then setting a stop. This establishes a setting position. For printing, that is, during a printing run, the air pressure in cylinder 12 can be increased to dampen out, and compensate for vibration in the roller system. The application of air pressure can be direct or through holding arms or the like, shown only schematically in FIGS. 2 and 3, since the particular design depends on overall machine construction.

Figure 3:
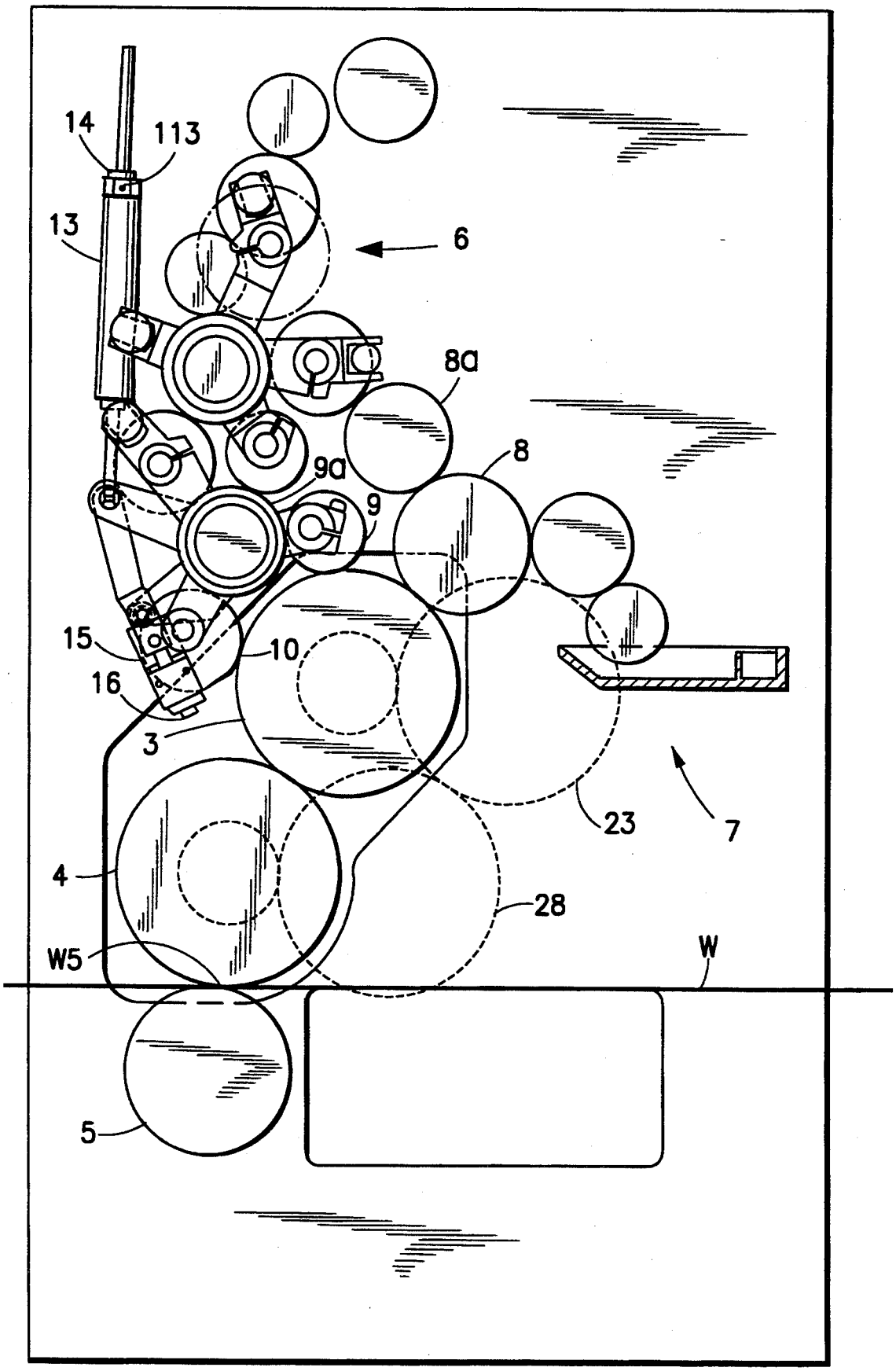
FIG. 3 is a detail view of a positioning arrangement to position two ink application rollers in the printing machine to fit plate cylinders of an offset printing machine system in which differently dimensioned plate cylinder sleeves and blanket cylinder sleeves can be used.

FIG. 3 is a highly schematic diagram of the positioning of the ink application rollers 9 and 10 on the sleeve 3. An air cylinder 13 is retained on the frame or side wall of the machine at a retention pivot 113. The air cylinder 13 is coupled to roller 10 of the ink train, as clearly seen in FIG. 3. By operating the air cylinder 13, rollers 9a, 10 can be repositioned from the positions shown in FIG. 3 to the positions schematically shown in FIG. 10, that is, for engagement with the circumference of a much smaller plate cylinder sleeve 3a. An air cylinder 15 is provided to engage the roller 10 against the circumference of sleeve 3. The air cylinder 15 has a positioning stop 16; the air cylinder 13 has a positioning stop 14. As before, the positions of the respective rollers are first set by providing the appropriate engagement pressure upon controlled pressurization of the respective air cylinders 13, 15, then setting the stops 14, 16, and then, for running, increasing the pressure in the air cylinders to compensate for vibration of the rollers. The application rollers 8, 9, 10 are not driven but are carried along by frictional engagement with the respective engaged rollers of the inker roller train and the dampener rollers, and specifically the engaged vibrating rollers 8a, 9a. At least roller 8, and preferably also roller 9, is axially fixed in the machine.

Rather than using a very long cylinder 13, as shown, which requires careful positioning in the machine, it is equally possible to obtain effectively the same movement by using only a much smaller air cylinder, similar to the cylinder 12, for example, pivotably or otherwise suitably secured to the machine frame at the upper left side thereof, and having its operating rod coupled through a mechanical amplification linkage, for example double-arm levers of unequal arm length, to the respective rollers 9a, 10; for example, the lower end point of piston rod 114 of the cylinder-piston arrangement 13 can be connected to the short arm of a double-arm lever which, in turn, has its longer arm connected to a bent or hook-like lever in engagement with an operating element coupled to the shaft of roller 9a and/or the shaft or roller 10. Such operating elements can include threaded spindles or rods to permit individual pressure adjustment.

Figure 4:
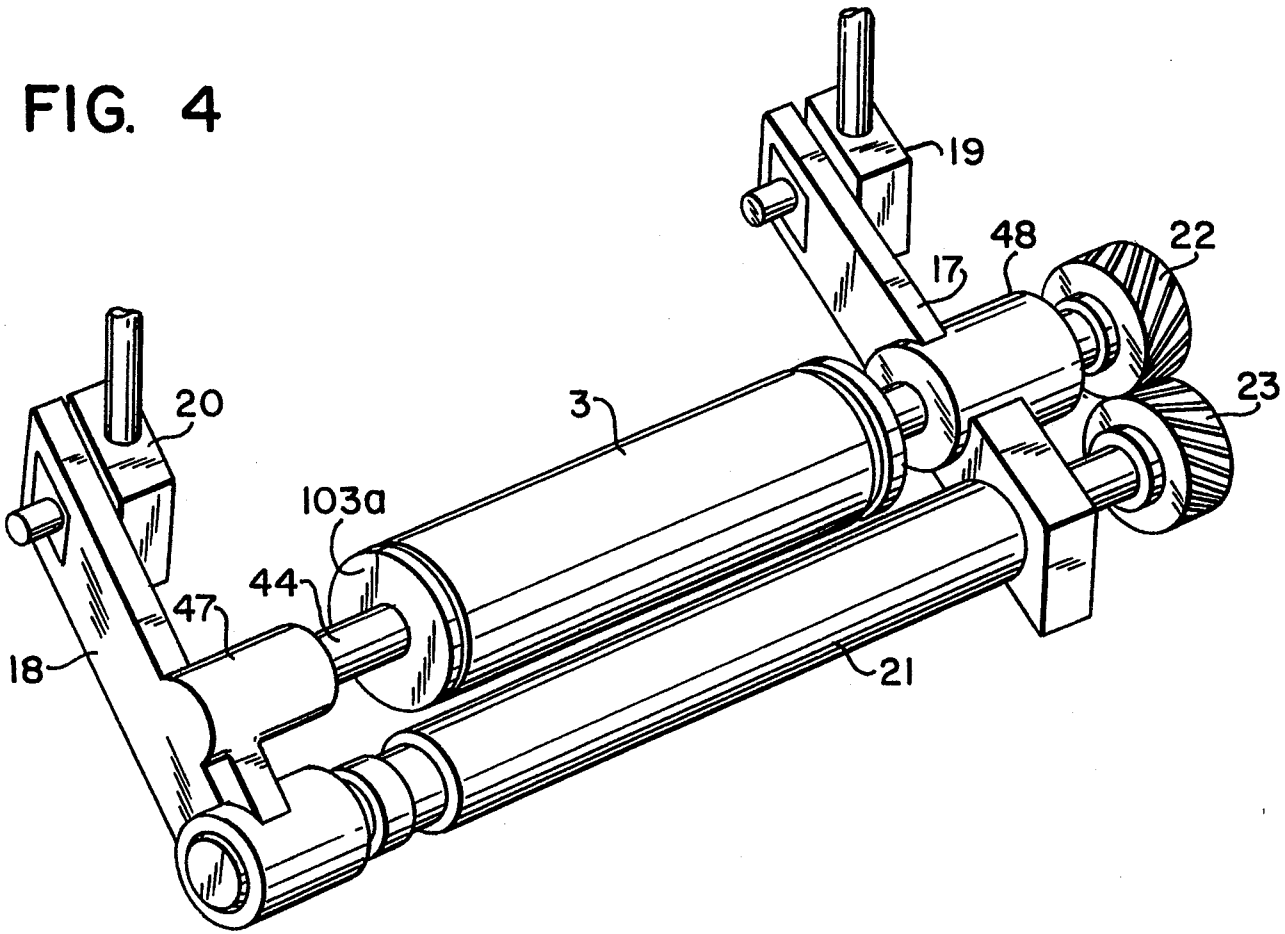
FIG. 4 shows, schematically, the retention of a plate cylinder having a plate cylinder sleeve.
Figure 5:
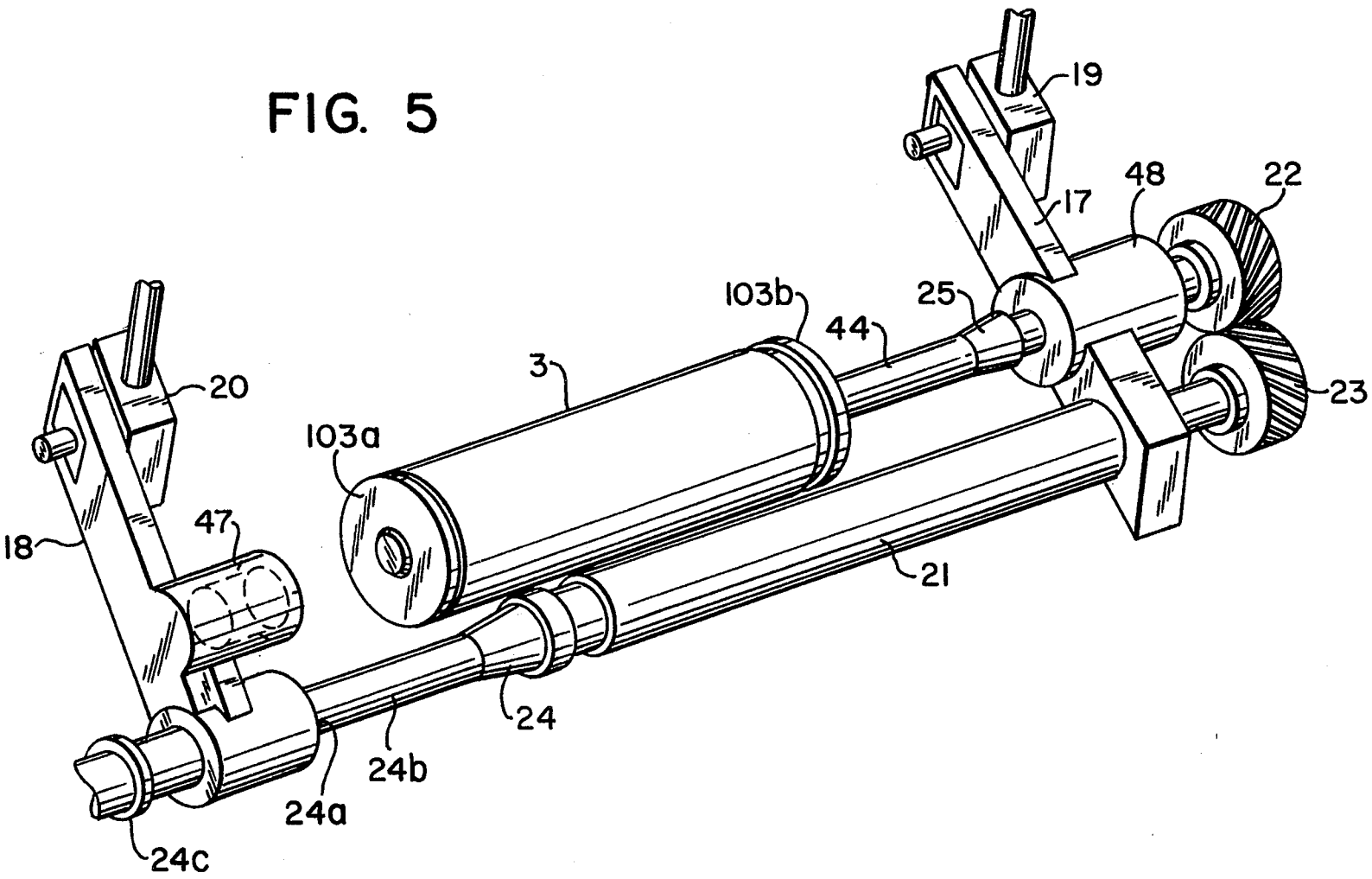
FIG. 5 is a partly exploded view illustrating lateral shifting of one of the holding arrangements for the plate cylinder to permit exchange of the plate cylinder sleeve.
Figure 6:
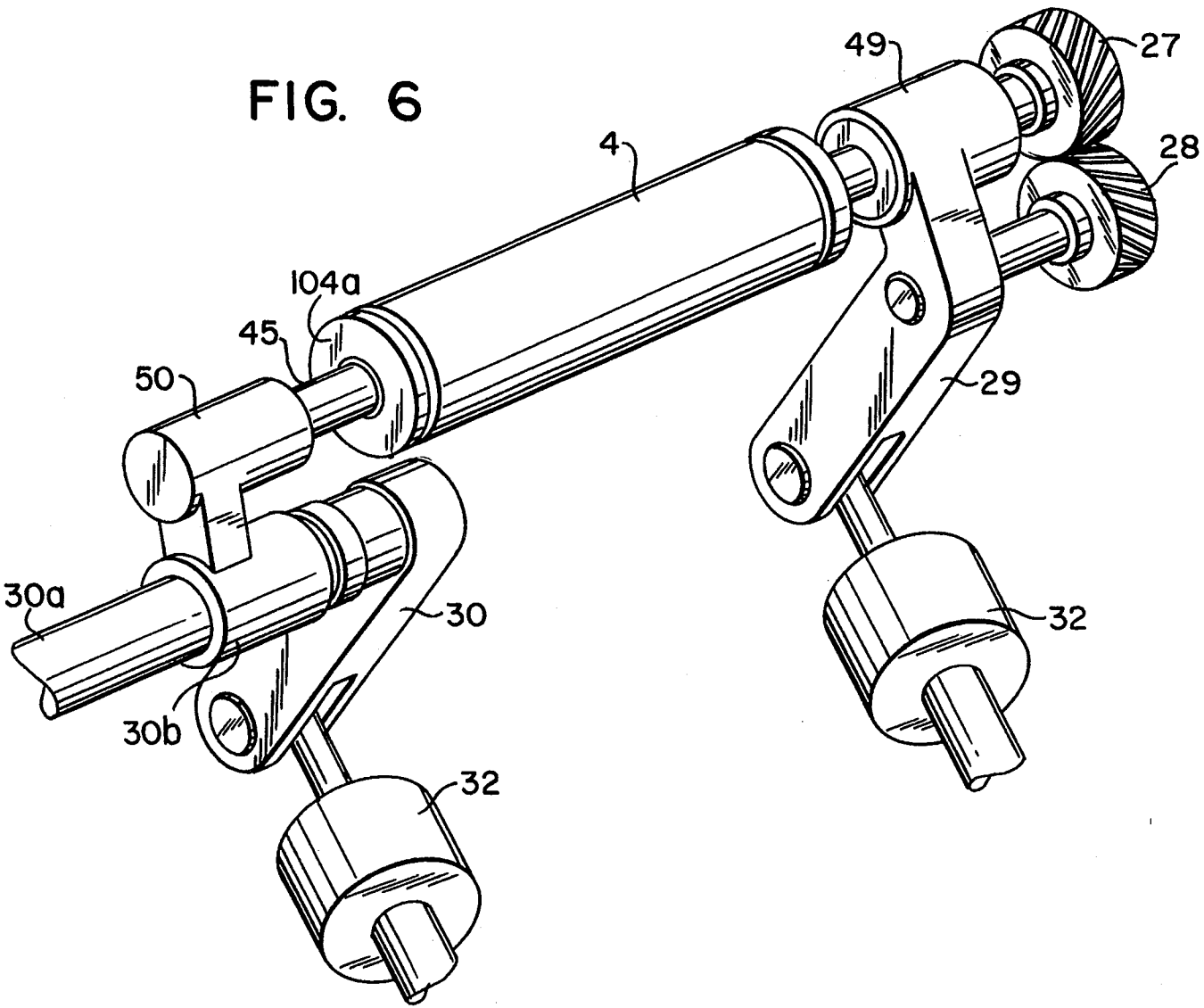
FIG. 6 is a highly schematic side view illustrating the bearing arrangement and retention of the blanket cylinder, including the blanket cylinder sleeve, when positioned for printing in the printing machine.

The movable retention of the plate cylinder, the blanket cylinder and the impression cylinder is best seen in FIGS. 4–8. In FIGS. 4, 5 and 6, the gears 22, 23 and 27, 28 are shown only schematically. Actually, the gear 23 has about twice the diameter as gear 22; and the gear 28 twice the diameter as gear 27 (see FIG. 12). In FIG. 4, the tie rod 21, which will be explained below, is normally spaced farther away from the circumference of even the largest cylinder sleeve 3.

Referring first to FIGS. 4 and 5, showing the retention of the plate cylinder unit 3:

In accordance with a feature of the invention, the shaft or core 44 of the plate cylinder unit is coupled to the sleeve 3 by a cone connection. Only the cone 25 on the shaft 44 is visible in FIG. 5; the end piece 103b of the sleeve 3 is formed with an internal conical surface, matching the cone taper of the cone 25. The end piece 103a has an internal cylindrical surface fitting on shaft 44. Two plate cylinder support arms 17, 18 are pivotably located in the side plates 1, 2 (see FIG. 12). Arms 17, 18, which are adjacent the side walls 1, 2, retain shaft 44 in bearings 48, 47. A tie shaft 21 is located parallel to the shaft 44. Conical end 24 of tie shaft 21 can be separated from its seat 24a in the arm 18. End cone 24 fits in a reception opening or seat 24a in the arm 18. The tie shaft 21, which does not rotate, is extended beyond the cone 24 by a cylindrical extension 24b, terminating in end plate or stop 24c. The function of the elements will be described in connection with the explanation of the exchange of sleeves on the cylinders. Gear 23 can rotate on an extension 21a (FIG. 12) being retained on the extension by suitable bearings 23a. The gear 23 and extension 21a are hollow to permit passage of a lateral register shaft from adjustment motor 46 (FIG. 12). Gear 22 thus can be rotated by intermediate machine drive gear 23 coupled to a main drive gear 28 (FIG. 11, and not shown in FIGS. 4 and 5) which will be described below. Preferably, gear 22 and engaging gears are helical gears as shown in FIGS. 4–6 of the drawings.

The retention of the blanket cylinder unit is conceptually similar to that of the plate cylinder. Referring now to FIG. 6: The shaft or core 45, on which the replaceable blanket cylinder sleeve 4 is located, is retained in two carrier arms 29, 30, one adjacent each side of the printing machine. Drive gear 27 is movable circumferentially about gear 28. Gear 28 is rotatably fixed in position in the side wall 2 of the printing machine.

The arm 29 can pivot about a pivot pin 29a, shown only schematically in FIG. 12; arm 30 can pivot about a bolt or pin 30a, positioned within a sleeve portion 30b of the arm 30. The axial position of the pins or bolts 29a, 30a are fixed in the respective side walls 2, 1.

Figure 7:
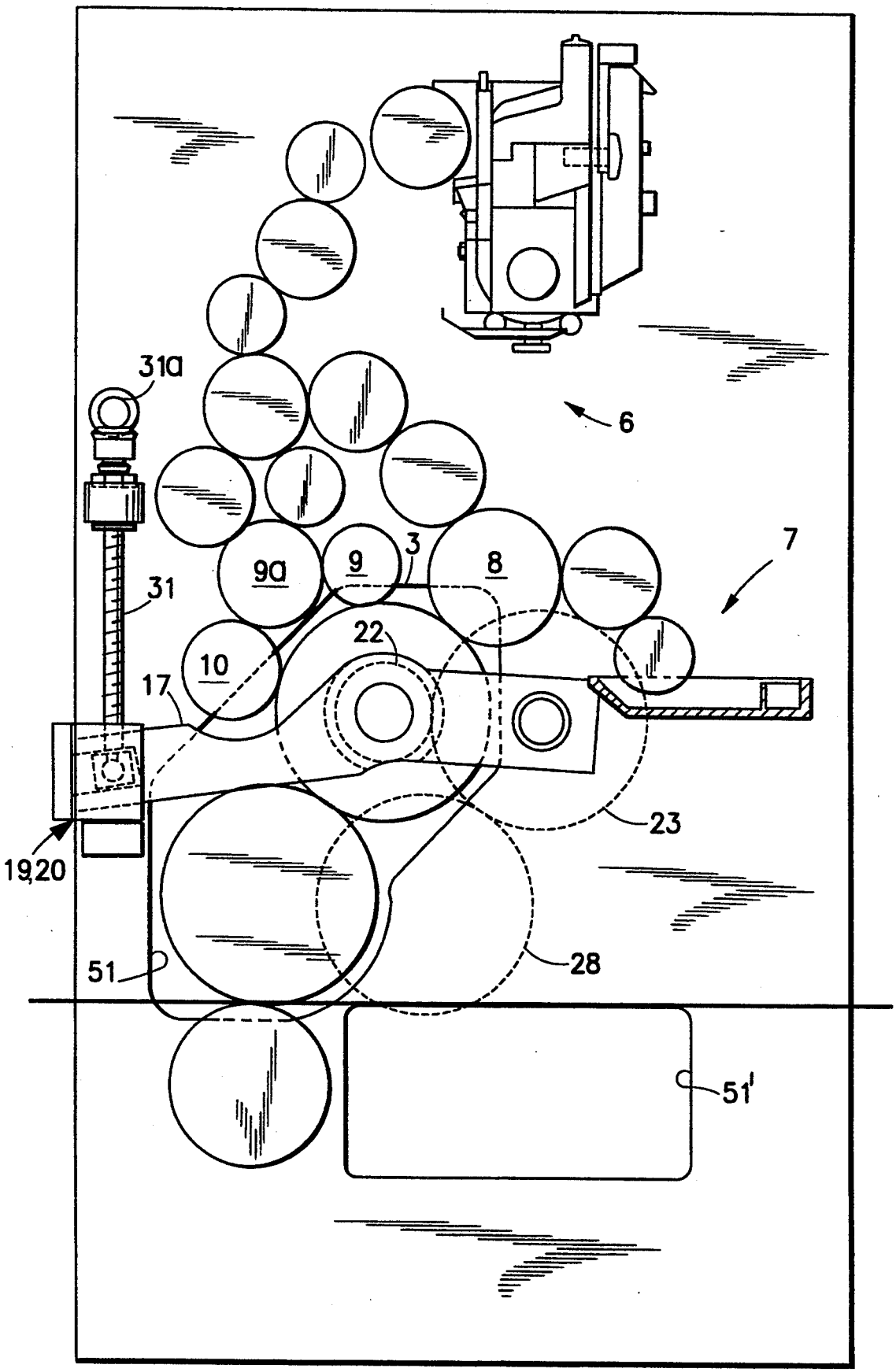
FIG. 7 is a schematic side view illustrating the bearing mechanism and retention of the plate cylinder.

The plate cylinder unit 3, 3a, 44 can be locked in place by locking or clamping devices 19, 20 (FIGS. 7 and 12). Referring to FIG. 7: The locking arrangements 19, 20 are coupled to positioning spindles or screws 31 which, for example, can be rotated by motors 31a, which pivot the arms 17, 18 about a fixed pivot point, concentric with the axis of rotation of gear 23 and hence concentric with tie rod or shaft 21. The gear 22 is secured or coupled to the plate cylinder shaft 44 at the end which carries the cone 25.

Figure 8:
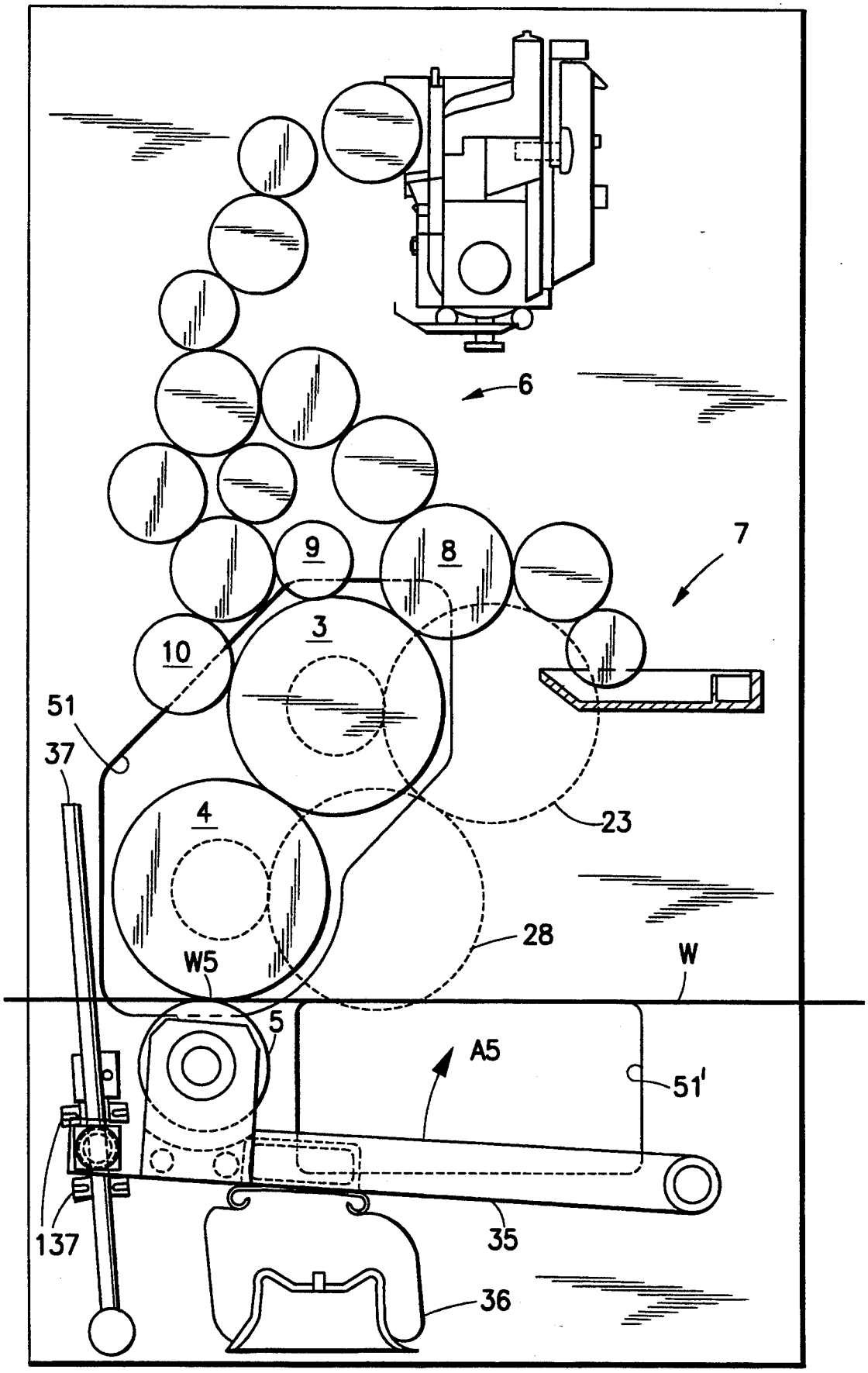
FIG. 8 is a highly schematic side view illustrating the repositioning arrangement for an impression cylinder, in which the impression cylinder, for purpose of illustration, is driven by friction of a web between the blanket cylinder and the impression cylinder.

Upon interchange of cylinder sleeves 3 and 4 by the smaller sleeves 3a, 4a, the print line W5 must be shifted upwardly. Referring now to FIG. 8: The impression cylinder 5 is located on an impression cylinder carrier arm 35, so that the impression cylinder 5 can be pushed upwardly. An air bladder 36 lifts the impression cylinder arm 35, the arm 35 moving in the direction of the arrow A5. The arm 35 is guided on a pivotable guide rod 37 with stops 137 thereon, so that the impression cylinder 5 is securely retained in position. Pneumatic pressure in the air bladder 36 compensates for vibration in the cylinder system. The air bladder can be similar to the type of bladder used on truck bodies to provide "air ride" quality to fragile loads; other elements, such as for example variable fluid pressure shock absorbers, could be used. A suitable printing pressure for printing on carton stock material is about 50 lbs. per lineal inch (about 8 kg/cm) of printing line W5. Access opening 51' in side wall 1 permits access to the impression cylinder retention system. The opening is not essential and the side wall 1 can be solid at the bottom.

The present invention permits an easy replacement of the printing surfaces of the plate cylinder and blanket cylinder, respectively, by replacing the cylinder sleeves 3, 4 externally of the printing machine itself, without requiring lifting of heavy weights, i.e. the weight of solid or unitary printing cylinders. In prior art apparatus, it was customary to replace the entire cylinder, that is, the surface region and the central part or cylinder shaft. In accordance with the present invention, it is only necessary to replace the cylinder sleeves carrying a printing plate and/or an offset blanket, respectively. Since only the cylinder sleeves 3, 3*a* are replaced, the drive gear 22 remains associated with the shaft or core 44 or, in other words, is uniquely assocatiated therewith and does not require replacement upon change of sleeve 3 to 3*a*, for example. A single plate cylinder shaft 44 and its drive gear 22 can be used with any one plate or form cylinder sleeve of the set of sleeves, e.g. with a sleeve 3 or a sleeve 3*a*. In direct printing, a blanket cylinder need not be used. The present invention, when using a single printing cylinder, thus, is not limited to the specific example in which the more complex mechanism of the offset system is shown. In printing cartons, particularly suitable for packages, it is preferred to use offset rotary printing machines, and the preferred system is described, in which a plate cylinder as well as blanket cylinder are used. The cylinders, contrary to prior art constructions, thus are not cylinders which are retained in the machine on which blankets or plates are clamped in clamping grooves but, rather, hollow cylindrical tubular sleeves are secured, with spacing, over cylinder shafts. These cylinder units are positioned within the machine in such a way that the outer circumference of the cylinders is defined by cylinder sleeves which can carry an endless blanket, or an endless printing plate, respectively and in which the shafts are so located that required drive engagements are assured, and the circumferences of the cylinders appropriately engaged for inking, dampening and image transfer regardless of diameter of the hollow cylinder sleeves fitted over the shafts.

Exchange of Sleeves of the Cylinder Units, with Reference to FIGS. 9–12

As best seen in FIG. 12, one end of the shafts 44, 45 remains in the associated gear side bearings 48, 49, located in the arms 17, 29, respectively. In FIG. 12, in the printing machine illustrated, the right side is the gear side of the machine. The left side as shown in FIG. 12 is termed the work side. The work side plate cylinder arm 18 as well as the blanket cylinder arm 30—see also FIGS. 4, 5 and 6—can be shifted towards the left to the positions shown at 18', 30', respectively, in the direction of the arrows A18, A30. This frees the left side of the shafts 44, 45. The work side wall 1 is formed with an access opening 51. The arms 18, 30 in the positions 18', 30' can be pivoted out of alignment with the opening 51, for example after release of the lock 20 on arm 18, and pivoting about pivot shafts or pins 24*b*, 30*a* (FIGS. 5, 6) and, if desired, entirely removed. Shaft extension 24*b* extends from the conical portion 24*a* (FIG. 5) and is shown, only schematically, in FIG. 12. The opening 51 in the left side wall 1 then becomes free and the sleeves 3, 4 can be removed. To free the conical seats. Hydraulic pressure is exerted through a bore 44*b*, 45*b* in the respective shafts 44, 45 to the taper 25. The resulting expansion frees sleeves 3, 3*a*, 4, 4*a* from the corresponding shaft 44, 45. For reseating a new sleeve, a hydraulic ram or jack is placed around undercut 44*a*, 45*a* of the respective shaft 44, 45 and hydraulic pressure is applied at the left side of the sleeve, with the hydraulic apparatus clamped on the undercut 44*a*, 45*a*.

Thus, any one sleeve pair 3, 4 or 3*a* 4*a*, or differently sized sleeve pairs can be used, so that it is not necessary to stock the expensive plate and blanket cylinders with accurately ground shafts and placement for accessory apparatus, such as gears and the like; it is only necessary to replace the outer sleeves which need not be made of the heavy steel, are hollow, and thus readily portable and substantially less expensive than entire cylinder structures. After pushing the sleeves on the respective shafts 44, 45, the arms are again placed in their appropriate position, and the arms 18, 30 are moved counter the direction of arrows 30 towards the right in FIG. 12, so that the left ends of the shafts 44, 45 are again fixed in position in the printing machine. At this point locks 19 and 20 are reengaged. Undercuts 18*b*, 30*b* on shafts 24*a*, 30*a* lock the arms 18, 30 with the use of a hydraulic ram or jack.

FIG. 12 also illustrates a lateral or side register control motor 46. Register control motor 46 is secured in position on the frame, as schematically shown, by a suitable flange and rotates a spindle 46*a*, passing through gear 23 and terminating in a threaded end and within a spindle nut in the holding structure for the tie shaft 21. Upon rotation of the shaft 46*a*, arm 17 moves back and forth in the direction of the arrow A46, and, with it, shaft 44 and the sleeve 3, 3*a* secured thereto by engagement of the respective cone seats 25, 103*b*.

Circumferential register is controlled, see FIG. 13, by a circumferential register control motor 43, which controls the position of a planetary gearing in gear box 43*a* (FIG. 13) receiving drive power from a main motor (not shown) and shaft 42*a* through a gear box 42. Motor 43 thus adjusts the circumferential register both of the blanket cylinder via gear 28 as well as of the plate cylinder via gear 23, coupled to gear 28 (FIG. 11).

The blanket cylinder shaft 45 (FIG. 12) is retained at the gear side in bearings 49 and at the work side in a bearing 50, which is secured to the arm 30. The bearing 50, together with the arm 30, can be moved out of alignment with the opening 51.

It is necessary to appropriately position the shafts 44, 45 with respect to each other in such a way that the circumferences of the respective sleeves 3, 4 or 3*a*, 4*a*, or sleeves of intermediate sizes are in engagement with each other, and, further, the plate cylinder sleeve 3 or 3*a*, can be inked and thus is in engagement with with at least one of the inker rollers, for a lithographic machine a combination ink-dampening liquid application roller 8. In the present embodiment, sleeve 3, 3*a* is also engaged against further inker rollers 9, 10. The printing machine shafts 44, 45 and the respective gears 22, 27, further, must be driven by machine drive gears 23, 28 which, in accordance with a feature of the invention, are fixed in the side wall 2 of the machine, that is, at the gear side.

Referring now to FIGS. 9 and 10, which show the gears 23, 28, which are in driving engagement with the gears 22, 27, respectively, driving the shafts 44, 45 of the plate and blanket sleeve, respectively. The blanket cylinder shaft 45 is moved and placed in position by threaded spindles 33, rotated by motor 33*a*. Throw-off is by pneumatic cylinders 32 (see also FIG. 6) coupled, respectively, to the carrier arms 29, 30 for the shaft 45. The position of the blanket cylinder sleeve 4, or 4*a*, respectively, is determined by shifting the shaft 45 by the pivotably retained spindles 33, and rolling off gear 27 about gear 28 (FIG. 6). Gear 28 is fixed in position in the side wall 2 of the machine, and has been omitted from FIG. 12 for clarity. The approximate position of the shaft 45, and hence of the circumference of the sleeve 4 or 4*a*, respectively, is determined by a stop 34 on a cylinder positioning spindle 33. The stop 34 is movable, as clearly seen by comparing FIGS. 9 and 10, in which, respectively, the positions for maximum size cylinders (FIG. 9) and minimum size cylinders (FIG. 10) are illustrated. The cylinder positioning stops 34 as well as the positioning screw or spindle 33 are coupled to the respective arms 29, 30. This coupling has been omitted from FIG. 6 for clarity; it can be, structurally, placed on an extension of the arm 29, 30, respectively, and omitted from FIG. 6 for clarity. The air cylinder 32 is used for exact positioning of the blanket cylinder sleeve 4. Air cylinder 32 is pressurized for proper printing cylinder position and pressure, that is, when the blanket on sleeve 4 contacts the plate on sleeve 3. Engagement is obtained by suitable pressurization of the cylinder 32. When this engagement pressure is at the proper printing pressure, a signal is provided to a control console to stop rotation of the spindle 33. This position then is set by the respective stop 34. The cylinder 32 can then remain pressurized, or receive more pressure, to compensate for vibration within the cylinder system. Release of air pressure in the cylinder 32 or air pressure in opposite direction will slightly lower the cylinder 4, thus providing for throw-off from the plate cylinder unit. Movement of the piston rod of the air cylinder 32 is schematically shown by the double arrow A32. The cylinder 32 can be constructed as a double-acting piston-cylinder unit, that is, upon reverse pressurization of the structure 32, throw-off of the blanket cylinder system 4, 45 is obtained pneumatically.

Similarly, the position of the plate cylinder shaft 44 is determined by the positioning screw 31 (see FIG. 7) and motor 31*a*. The gear 22 rolls off on gear 23. Gear 23 has its axis of rotation fixed in the side wall 2 of the gear side by rotating about hollow shaft 21*a* (FIG. 12). The position of the carrier arms 17, 18 is determined by suitable stops placed on the spindle 31. FIG. 9, again, shows the largest size plate cylinder sleeve 3 and the largest size blanket cylinder sleeve 4 in position with the respective gears engaged thereagainst, whereas FIG. 10 shows the smallest plate cylinder-blanket cylinder sleeves 3*a*, 4*a* of the printing couple.

The drive gearing for the respective cylinder shafts as well as for the inker is best seen in FIG. 11. The oscillating or vibrating inker rollers 8*a*, 9*a* are axially fixed in position in side wall 2 at the gear side of the machine. They are driven by gears 38, 40 which derive rotary power from a gear 37, driven by a suitable inker drive motor shown only schematically at 37*a*. Gears 39,41 transmit further drive power from gear 38 to other inker rollers which require drive. Specific designation of the entire drive gearing has been omitted since it can be of conventional construction. The shafts of the application rollers 8, 9, 10 are not driven; these rollers receive their rotary energy by circumferential frictional engagement with the driven rollers or cylinders with which they are in contact. FIG. 11, additionally, shows the main drive through gear box 42, which drives gear 28 which, in turn, drives gear 27 of the blanket cylinder through circumferential register gear box 43*a*; the motor, through gear box 42, through gear 28, also drives gear 23 which is in engagement with the plate cylinder gear 22.

The sleeves 3, 3*a*, 4, 4*a*, generally, are hollow cylindrical structures having end caps or end disks 103*a*, 103*b*, 104*a*, 104*b*, respectively, formed with an internal bearing or support structure to surround the respective shaft 44, 45. The internal, generally tubular bearing structures 103*b*, 104*b* taper, i.e. are partly conical to fit the respective cones on shafts 44, 45, of which only cone 25 is visible in FIG. 5.

FIG. 13, highly schematically, shows the register control, both for side register by motor 46, and circumferential register by motor 43 via planetary gearing 43*a*. The illustration of FIG. 13 is for explanatory purposes, and the blanket cylinder shaft 45 with blanket cylinder sleeve 4 is shown rotated 180 out of position. Shaft 21 does not rotate but merely shifts the position of the plate cylinder shaft 44 in accordance with arrow A46 (see also FIG. 12) while also providing structural stiffness. Shaft 21, additionally, has a holding function for the left or work side arm 18, when the arm 18 is in the printing position, that is, holding the left or work side of the shaft 44 in its bearing. When the arm 18 is shifted to the position 18′, the portion of the bearing 47, retained in the arm 18, of course moves with it to the position only schematically shown at 47′ in FIG. 12. Bearing 50 for shaft 45, likewise, moves with arm 30.

Numerous elements, customary and usual in printing machines, are shown schematically, without being further identified, since their placement and function will be obvious to those skilled in the art; they have been retained in the drawing merely to illustrate how the system and apparatus in accordance with the present invention interrelates with an entire printing machine.

The present invention, thus, provides a highly versatile printing machine in which cylinder sleeves of different sizes or cut-off lengths within a predetermined range of cut-off lengths can be readily exchanged. The gears 23, 28 remain in continuous mesh, and continuously drive the respective plate cylinder gear 22 and blanket cylinder gear 27. The gears 22, 27 can swing about the circumference of the engaged meshing gears 23, 28—compare FIGS. 9 and 10. When exchanging printing sleeves 3, 4—maximum size—for sleeves 3*a*, 4*a*—minimum size—of course, the circumferential speed or surface speed of the printing cylinders as well as of the inker rollers should remain about the same. Thus, the main drive motor 42 as well as the inker motor 37*a* should be variable speed motors, or motors having a variable gearing or variable speed transmission.

Rotation of the respective spindle drives 31, 31*a*; 33, 33*a* and pressurization of the respective air cylinders can all be controlled from a general control console and suitably interlocked to prevent malfunction.

We claim:

1. Rotary web offset printing machine, especially adapted for printing on thicker carton-type stock webs for packaging of merchandise, having spaced side wall elements (1, 2);

a printing cylinder shaft or core (44) having a predetermined diameter;

a selectively removable and replaceable printing cylinder sleeve (3, 3a) positioned on, and surrounding the shaft or core, said printing cylinder sleeve comprising a specific sleeve within a set of sleeves (3, 3a), each sleeve of said set of sleeves fitting on said shaft or core (44), and in which each sleeve of said set of sleeves has an individual outer circumference dimension within a predetermined range of circumference dimensions;

rotation-symmetrical support means (103a, 103b) at axial ends of the printing cylinder sleeve (3, 3a) retaining said sleeve on the shaft or core, said sleeve (3, 3a) forming a replaceable axially removable element, for selective replacement with another printing cylinder sleeve of a different circumference dimension of said set on said shaft or core;

machine drive means (23) located at a fixed position in the machine;

a cylinder drive means (22) uniquely provided for said shaft or core (44) and secured to the shaft or core (44) and drivingly connectable with the machine drive means (23), said cylinder drive means being dimensioned for engagement with said machine drive means (23);

an inker (6, 8, 9, 10) having at least one inker roller (8, 9) located in and positionable in the machine for circumferential engagement with the specific cylinder sleeve (3, 3a) of the selected circumference dimension then positioned on the shaft or core (44);

movable shaft support means (17–20) supporting said cylinder shaft or core (44) coupled to said shaft or core (44) on the machine, said shaft support means (17–20) selectively positioning or repositioning the printing cylinder shaft or core (44) and hence the cylinder drive means (22) secured thereto with respect to the machine drive means (23) at selected positions in the printing machine in dependence on the circumference dimension of the specific printing cylinder sleeve (3, 3a) within said range on said cylinder shaft or core (44), while maintaining driving connectability of the printing cylinder drive means (22) with the machine drive means (23); and further comprising a blanket cylinder shaft or core (45);

a blanket cylinder sleeve (4, 4a) surrounding the blanket cylinder shaft or core, and having a blanket circumference dimension within said predetermined range of circumference dimensions;

a blanket cylinder drive means (28) at an axially fixed location in one (2) of the side wall elements and coupled to the machine drive means (23);

a blanket cylinder shaft drive means (27) coupled to the blanket cylinder shaft (45) and in driving engagement with said blanket cylinder drive means (28); and movable blanket cylinder shaft support means (30, 32, 50) movably secured to the side wall elements (1,2) and supporting said blanket cylinder shaft or core (45) and said blanket cylinder shaft drive means (27) coupled to said blanket cylinder core or shaft, said blanket cylinder shaft support means selectively positioning the blanket cylinder shaft drive means (27) with respect to the blanket cylinder drive means (28), and the blanket cylinder shaft or core (45) for circumferential engagement of the specific blanket cylinder sleeve (4, 4a) of the selected circumference dimension on said blanket cylinder shaft or core, with respect to the printing cylinder sleeve (3, 3a) of a coordinate selected circumference dimension within said range.

2. The machine of claim 1, further including an impression cylinder (5) the axis of which is movably located for engagement of said impression cylinder with said blanket cylinder sleeve (4, 4a) of any selected circumference dimension within said range, with a web (W) interposed, and movable impression cylinder support means (35, 36, 37) movably positioning the impression cylinder for engagement with the web and said blanket cylinder sleeve (4, 4a).

3. The machine of claim 1, wherein the printing cylinder drive means (22), the machine drive means (23), the blanket cylinder shaft drive means (27), and the blanket cylinder drive means (28) comprise gear wheels;

a main drive (42) is provided, coupled to at least one of said gear wheels which is located at an axially fixed location in the machine;

wherein said movable shaft support means (17–20) and said blanket cylinder shaft support means (30, 32, 50) move the associated cylinder drive gear wheel (22) and blanket cylinder shaft drive gear wheel (27), respectively, in dependence on the circumference dimension of the respective printing cylinder sleeve (3, 3a) and the blanket cylinder sleeve (4, 4a), circumferentially about, respectively, the machine drive means (23) and the blanket cylinder drive means (28);

and position retention means (33, 34) are provided for determining the position of the respective drive wheel means, and hence the cylinder sleeves in dependence on their circumference dimensions in the machine.

4. The machine of claim 1, wherein the blanket cylinder shaft or core (45) and the blanket cylinder shaft support means (30, 32, 50) are supported within the spaced side wall elements (1, 2) for moving the blanket cylinder shaft drive means (27) about the blanket cylinder drive means (28) while maintaining printing image transfer contact between the blanket cylinder sleeve (4, 4a) and the printing cylinder sleeve (3, 3a) regardless of the circumference dimension of the respective cylinder sleeve.

5. The machine of claim 1, further including positioning means (31) comprising a positioning screw or spindle (31) controlling the movable shaft support means (17, 20) of the printing cylinder shaft or core (44), said positioning spindle (31) including stop means for setting the position of the printing cylinder shaft or core in dependence on the circumference dimension of the printing cylinder sleeve thereon; and position control means (33, 33a) coupled to the blanket cylinder shaft support means (30, 32, 50) comprising a positioning spindle (33) and stop means (34) thereon for setting the position of the blanket cylinder shaft or core (44) in dependence on the circumference dimension thereof, and of the circumference dimension of the printing cylinder (3, 3a).

6. The machine of claim 1, further including throw-off means (32; 29, 30) coupled to the blanket cylinder shaft support means for moving the blanket cylinder shaft slightly away from the position of the stop means for throwing off the blanket cylinder shaft or core (45).

7. The machine of claim 2, including pneumatic support means (36) having a pneumatically expandible bladder (36) supporting said impression cylinder (5) and providing a pneumatic, resilient biassing force for said impression cylinder (5) against the web (W) in engagement with said impression cylinder (5).

8. The machine of claim 7, further including mechanical means (37, 137) positively positioning the impression cylinder with respect to said web (W) within a positioning range, said bladder (36), upon inflation and deflation, providing for throw-off of the impression cylinder (5) or, respectively, furnishing engagement pressure for printing against said web.

9. The machine of claim 1, wherein said shaft support means comprise pivotable support arms; and further including combined mechanical-fluid pressure means coupled to the support arms, having stop means for determining the position of the arms, and fluid pressure supply means for providing a resilient positioning force and absorb vibration.

10. The machine of claim 1, wherein said inker has at least one ink application roller (10) which is movably secured in the side wall element;

and fluid pressure positioning means (14, 113; 15, 16) are provided, coupled to said at least one movable ink application roller (10), said fluid pressure positioning means including stop means (113) for setting a position of said at least one ink application roller, while providing cushioned pressurized fluid engagement of said ink application roller with the printing cylinder sleeve (3, 3*a*).

11. The machine of claim 1, further including an impression cylinder (5) the axis of which is movably located for engagement of said impression cylinder with said blanket cylinder sleeve (4, 4*a*) of any selected circumference dimension within said range, with a web (W) interposed, and movable impression cylinder support means (35, 36, 37) movably positioning the impression cylinder for engagement with the web and said blanket cylinder sleeve (4, 4*a*).

12. The machine of claim 1, wherein at least one of said printing cylinder shaft or core (44) and said blanket cylinder shaft or core (45) has a fixed end with an essentially part-conical outer surface at the side of the cylinder drive means (22) and a respective sleeve (3, 3*a*; 4, 4*a*) has an inner, matching, essentially part-conical or tapered end portion.

13. The machine of claim 12, including fluid pressure means engageable against said respective sleeve (3, 3*a*; 4, 4*a*) for pushing the respective sleeve off the essentially part-conical end to permit changing the respective sleeve from one of a first circumference dimension within said range to another respective sleeve of another circumference dimension.

14. Rotary web printing machine, especially adapted for printing on thicker carton-type stock webs for packaging of merchandise, having spaced side wall elements (1, 2);

a printing cylinder shaft or core (44) having a predetermined diameter;

a selectively removable and replaceable printing cylinder sleeve (3, 3*a*) positioned on, and surrounding the shaft or core, said printing cylinder sleeve comprising a specific sleeve within a set of sleeves (3, 3*a*), each sleeve of said set of sleeves fitting on said shaft or core (44), and in which each sleeve of said set of sleeves has an individual outer circumference dimension within a predetermined range of circumference dimensions;

rotation-symmetrical support means (103*a*, 103*b*) at axial ends of the printing cylinder sleeve (3, 3*a*) retaining said sleeve on the shaft or core, said sleeve (3, 3*a*) forming a replaceable axially removable element, for selective replacement with another printing cylinder sleeve of a different circumference dimension of said set on said shaft or core;

machine drive means (23) located at a fixed position in the machine;

a cylinder drive means (22) uniquely provided for said shaft or core (44) and secured to the shaft or core (44) and drivingly connectable with the machine drive means (23), said cylinder drive means being dimensioned for engagement with said machine drive means (23);

an inker (6, 8, 9, 10) having at least one inker roller (8, 9) located in and positionable in the machine for circumferential engagement with the specific cylinder sleeve (3, 3*a*) of the selected circumference dimension then positioned on the shaft or core (44); and movable shaft support means (17–20) supporting said cylinder shaft or core (44) coupled to said shaft or core (44) on the machine, said shaft support means (17–20) selectively positioning or repositioning the printing cylinder shaft or core (44) and hence the cylinder drive means (22) secured thereto with respect to the machine drive means (23) at selected positions in the printing machine in dependence on the circumference dimension of the specific printing cylinder sleeve (3, 3*a*) within said range on said cylinder shaft or core (44), while maintaining driving connectability of the printing cylinder drive means (22) with the machine drive means (23); and wherein the printing cylinder shaft or core (44) and the movable shaft support means (17–20) are positioned within the spaced side wall elements (1, 2) of the machine for moving the printing cylinder drive means (22) about the machine drive means (23) while maintaining engagement with respect to at least one inker roller (8, 9) located on and axially fixed to the side wall elements.

15. The machine of claim 14, wherein the printing machine is an offset printing machine and further comprises a blanket cylinder shaft or core (45);

a blanket cylinder sleeve (4, 4*a*) surrounding the blanket cylinder shaft or core, and having a blanket circumference dimension within said predetermined range of circumference dimensions;

a blanket cylinder drive means (28) at an axially fixed location in one (2) of the side wall elements and coupled to the machine drive means (23);

a blanket cylinder shaft drive means (27) coupled to the blanket cylinder shaft (45) and in driving engagement with said blanket cylinder drive means (28); and movable blanket cylinder shaft support means (30, 32, 50) movably secured to the side wall elements (1,2) and supporting said blanket cylinder shaft or core (45) and said blanket cylinder shaft drive means (27) coupled to said blanket cylinder core or shaft, said blanket cylinder shaft support means selectively positioning the blanket cylinder shaft drive means (27) with respect to the blanket cylinder drive means (28), and the blanket cylinder shaft or core (45) for circumferential engagement of the specific blanket cylinder sleeve (4, 4a) of the selected circumference dimension on said blanket cylinder shaft or core, with respect to the printing cylinder sleeve (3, 3a) of a coordinate selected circumference dimension within said range;

and wherein the movable blanket cylinder shaft support means (30, 32, 50) comprise two groups, one of said groups being movably secured to one of the side wall elements (1) for axial movement with respect to the blanket cylinder shaft or core (45), the other one of said elements being axially fixed with respect to the other side wall element (2);

the opening (51) formed in said one side wall (1) being of sufficient size to permit access also to the blanket cylinder sleeve (4, 4a) upon axial shifting movement of said one blanket cylinder shaft support means group, the other support means group retaining the blanket cylinder shaft or core (45) in bearing means located adjacent the other side wall (2), said one group of movable blanket cylinder shaft support means including a bearing means for the blanket cylinder shaft or core (45) and movable with the movable blanket cylinder shaft support means, whereby, by lateral axial movement of the blanket cylinder shaft support means of the first group, access is provided through the opening (51) in said one side wall (1) to also permit re-sleeving of the blanket cylinder shaft or core (45) with a sleeve of different predetermined circumference dimension within said range, and subsequent re-positioning of the blanket cylinder shaft or core (45) in the bearing of said one group of shaft support means.

16. Rotary web printing machine, especially adapted for printing on thicker carton-type stock webs for packaging of merchandise, having spaced side wall elements (1, 2);

a printing cylinder shaft or core (44) having a predetermined diameter;

a selectively removable and replaceable printing cylinder sleeve (3, 3a) positioned on, and surrounding the shaft or core, said printing cylinder sleeve comprising a specific sleeve within a set of sleeves (3, 3a), each sleeve of said set of sleeves fitting on said shaft or core (44), and in which each sleeve of said set of sleeves has an individual outer circumference dimension within a predetermined range of circumference dimensions;

rotation-symmetrical support means (103a, 103b) at axial ends of the printing cylinder sleeve (3, 3a) retaining said sleeve on the shaft or core, said sleeve (3, 3a) forming a replaceable axially removable element, for selective replacement with another printing cylinder sleeve of a different circumference dimension of said set on said shaft or core;

machine drive means (23) located at a fixed position in the machine;

a cylinder drive means (22) uniquely provided for said shaft or core (44) and secured to the shaft or core (44) and drivingly connectable with the machine drive means (23), said cylinder drive means being dimensioned for engagement with said machine drive means (23);

an inker (6, 8, 9, 10) having at least one inker roller (8, 9) located in and positionable in the machine for circumferential engagement with the specific cylinder sleeve (3, 3a) of the selected circumference dimension then positioned on the shaft or core (44); and movable shaft support means (17–20) supporting said cylinder shaft or core (44) coupled to said shaft or core (44) on the machine, said shaft support means (17–20) selectively positioning or repositioning the printing cylinder shaft or core (44) and hence the cylinder drive means (22) secured thereto with respect to the machine drive means (23) at selected positions in the printing machine in dependence on the circumference dimension of the specific printing cylinder sleeve (3, 3a) within said range on said cylinder shaft or core (44), while maintaining driving connectability of the printing cylinder drive means (22) with the machine drive means (23); and wherein the movable shaft support means (17–20) comprise two groups, one of said groups being movably secured to one of the side wall elements (1) for axial movement with respect to the printing cylinder shaft or core (44), the other one of said elements being axially fixed with respect to the other side wall element (2);

an opening (51) formed in said one side wall (1) of sufficient size to permit access to the printing cylinder sleeve (3, 3a) upon axial shifting movement of said one support means group, the other support means group retaining the cylinder drive means and the printing cylinder shaft or core (44) in bearing means located adjacent the other side wall (2), said one group of movable support means including a bearing means (47) for the printing cylinder shaft or core (44) and movable with the movable shaft support means, whereby, by lateral axial movement of the shaft support means of the first group, access is provided through the opening (51) in said one side wall (1) to permit re-sleeving of the printing cylinder shaft or core (44) with a sleeve of different predetermined circumference dimension within said range, and subsequent re-positioning of the printing cylinder shaft or core (44) in the bearing (47) of said one group of shaft support means.

17. Rotary web printing machine, especially adapted for printing on thicker carton-type stock webs for packaging of merchandise, having spaced side wall elements (1, 2);

a printing cylinder shaft or core (44) having a predetermined diameter;

a selectively removable and replaceable printing cylinder sleeve (3, 3a) positioned on, and surrounding the shaft or core, said printing cylinder sleeve comprising a specific sleeve within a set of sleeves (3, 3a), each sleeve of said set of sleeves fitting on said shaft or core (44), and in which each sleeve of said set of sleeves has an individual outer circumference dimension within a predetermined range of circumference dimensions;

rotation-symmetrical support means (103a, 103b) at axial ends of the printing cylinder sleeve (3, 3a) retaining said sleeve on the shaft or core, said sleeve (3, 3a) forming a replaceable axially removable element, for selective replacement with another printing cylinder sleeve of a different circumference dimension of said set on said shaft or core;

machine drive means (23) located at a fixed position in the machine;

a cylinder drive means (22) uniquely provided for said shaft or core (44) and secured to the shaft or core (44) and drivingly connectable with the machine drive means (23), said cylinder drive means being dimensioned for engagement with said machine drive means (23);

an inker (6, 8, 9, 10) having at least one inker roller (8, 9) located in and positionable in the machine for circumferential engagement with the specific cylinder sleeve (3, 3a) of the selected circumference dimension then positioned on the shaft or core (44); and movable shaft support means (17–20) supporting said cylinder shaft or core (44) coupled to said shaft or core (44) on the machine, said shaft support means (17–20) selectively positioning or repositioning the printing cylinder shaft or core (44) and hence the cylinder drive means (22) secured thereto with respect to the machine drive means (23) at selected positions in the printing machine in dependence on the circumference dimension of the specific printing cylinder sleeve (3, 3a) within said range on said cylinder shaft or core (44), while maintaining driving connectability of the printing cylinder drive means (22) with the machine drive means (23);

wherein said printing cylinder shaft or core (44) has a fixed end with an essentially part-conical outer surface at the side of the cylinder drive means (22) and said sleeve (3, 3a) has an inner, matching, essentially part-conical end portion.

18. The machine of claim 17, including fluid pressure means engageable against said sleeve (3, 3a) for pushing the sleeve off the essentially part-conical or tapered end to permit changing the sleeve from one of a first circumference dimension within said range to another sleeve of another circumference dimension.

19. Rotary web printing machine, especially adapted for printing on thicker carton-type stock webs for packaging of merchandise, having a printing unit (100) including side walls (1, 2);

at least one printing cylinder, optionally a plate cylinder, and an impression cylinder (5) located between the side walls of the machine;

an inker (6, 8, 9, 10) having at least one inker roller (8, 9) positioned between the side walls of the machine, and transferring ink by surface contact to the printing cylinder, wherein, in accordance with the invention, the at least one printing cylinder comprises a printing cylinder shaft or core (44); and a selectively removable and replaceable printing cylinder sleeve (3, 3a) positioned on and surrounding the shaft or core, said printing cylinder sleeve comprising a specific sleeve within a set of sleeves (3, 3a) in which each sleeve has an individual outer circumference dimension, within a predetermined range of circumference;

a machine drive means (23) is provided, located at an axially fixed position between the side walls of the machine;

wherein the printing cylinder shaft or core (44) is positionable between said side walls at respectively different axial locations in dependence on the outer circumference dimension of the specific sleeve (3 or 3a) on the shaft or core, while maintaining driving connection of the cylinder shaft or core (44) with the machine drive means (23) at its fixed position in the machine, and inker surface contact of the specific sleeve with at least one of the inker rollers of the inker; and cylinder support arms (17, 18) one, each, located adjacent a side wall of the machine, supporting and journaling the printing cylinder shaft or core (44), and pivotable about the axis of rotation of the machine drive means (23) for positioning the specific printing cylinder sleeve (3, 3a) in said contact engagement with at least one of the rollers of the inker and the cylinder drive means (22) in engagement with the machine drive means (23); and wherein, for exchange of a specific printing cylinder sleeve with a sleeve of a different circumference dimension, within said range, one end region of the printing cylinder shaft or core (44) is securely retained in a bearing in one (17) of the support arms adjacent one (2) of the side walls (1, 2) of the machine, and the other end region of the printing cylinder shaft or core is removable from the other support arm (18) adjacent the other (1) side wall;

said other side wall being formed with an opening (51) to provide for access to the printing cylinder shaft or core for exchange of cylinder sleeves (3, 3a) and subsequent re-positioning of the other carrier arm adjacent said other side wall (1).

20. The printing machine of claim 19, wherein the machine is a rotary offset printing machine, further comprising:

a blanket cylinder shaft or core (45) located between the plate cylinder shaft or core (44) and the impression cylinder (5), blanket cylinder shaft drive means (27) located on the blanket cylinder shaft or core (45);

blanket cylinder drive means (28) located at a fixed position between said side walls in the machine;

a selectively removable and replaceable blanket sleeve (4, 4a) positioned on and surrounding the blanket cylinder shaft or core, said blanket cylinder sleeve comprising a specific blanket sleeve within a set of blanket sleeves (4, 4a) in which each blanket sleeve has an individual outer circumference dimension within a predetermined range of circumference, and wherein the blanket cylinder shaft or core (45) is positionable between said side walls at respectively different axial locations in dependence on the outer circumference dimension or cut-off length or size of the specific blanket sleeve (4 or 4a) on the blanket cylinder shaft or core while maintaining driving connection with the blanket cylinder drive means (28) at its fixed position in the machine, and in printing surface contact with the printing cylinder sleeve (3, 3a) on the printing cylinder shaft or core (44), said impression cylinder (15) being engageable against the blanket cylinder sleeve (4 or 4a), with the web (W) therebetween;

wherein said opening (51) in the other side wall provides for access also to said blanket cylinder shaft or core (45) for exchange of blanket cylinder sleeves (4, 4a); and blanket cylinder support arms are provided one, each, located adjacent a side wall of the machine, supporting and journaling the blanket cylinder shaft or core (45), and pivotable about the axis of rotation of the machine drive means for positioning the specific blanket cylinder sleeve (4, 4*a*) in said contact engagement with the printing cylinder, and the blanket cylinder drive means in engagement with the machine drive means; and for exchange of a specific blanket cylinder sleeve with a sleeve of a different circumference dimension, within said range, one end region of a blanket cylinder shaft or core (45) is securely retained in a bearing in one of the blanket cylinder support arms adjacent one (2) of the side walls (1, 2) of the machine, and the other end region of the blanket cylinder shaft or core is removable from the support arm adjacent the other (1) side wall.

* * * * *